US006171666B1

(12) United States Patent
Wolf

(10) Patent No.: US 6,171,666 B1
(45) **Date of Patent: *Jan. 9, 2001**

(54) COMPOSITE JEWELRY STONE

(76) Inventor: Steven J. Wolf, 161 E. 79th St., New York, NY (US) 10021

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/866,503

(22) Filed: May 30, 1997

(51) Int. Cl.[7] ..... A44C 17/00
(52) U.S. Cl. ..... 428/15; 63/28
(58) Field of Search ..... 428/15; 63/28

(56) References Cited

U.S. PATENT DOCUMENTS

| | | | |
|---|---|---|---|
| D. 48,499 | 2/1916 | Robbins | D11/90 |
| D. 68,641 | 11/1925 | Robbins | D11/34 |
| D. 68,642 | 11/1925 | Robbins | D11/34 |
| D. 68,644 | 11/1925 | Robbins | D11/34 |
| D. 68,931 | 12/1925 | Robbins | D11/34 |
| D. 71,325 | 10/1926 | Bornkessel | D11/34 |
| D. 71,326 | 10/1926 | Bornkessel | D11/34 |
| D. 85,237 | 9/1931 | Gross | D11/34 |
| 138,314 | 4/1873 | Bruhl | 63/32 |
| D. 139,667 | 12/1944 | Klein | D11/26 |
| D. 196,868 | 11/1963 | Nagy . | |
| D. 250,100 | 10/1978 | Finker et al. | D11/90 |
| D. 262,300 | 12/1981 | Lundy | D21/534 |
| D. 276,143 | 10/1984 | Williams | D11/90 X |
| D. 324,003 | 2/1992 | Baranes | D11/90 |

(List continued on next page.)

FOREIGN PATENT DOCUMENTS

| | | |
|---|---|---|
| 859885 | 9/1940 | (FR) . |
| 1120076 | 6/1956 | (FR) . |
| 1015310 | 12/1965 | (GB) . |

OTHER PUBLICATIONS

Photocopy of "JCK What's New", Jewelers—Circular–Keystone, Feb. 1990, p. 192.
Photocopy of diamond necklace from Christies Catalog, undated, p. 214.
"*Diamond Cutting*", 4th Ed., by Basil Watermeyer, definition of "Trilliant", 1960.
"Designer Diamonds The Comtemporary Shapes of Designer Diamond Jewelry", *JQ Jewelers quarterly*, 1st quarter, 1987, pp. 18 and 19.
"The Trillion", *Diamond World Review*, Summer 1980, pp. 920–923.
"Dresden Green Diamond", *Gems & Gemology*, Winter 1990, p. 258.
"Jewellery", *Sotheby's Art At Auction*, 1980–81, p. 254.
Unidentified photocopy, Rizzoli International Publications, Inc., p. 168 and unnumbered page (admitted prior art).
Declaration of Leda Taveras, dated Jan. 6, 1997.
Declaration of Robert Wueste, dated Jan. 6, 1997.
"A Blazing Display Of Brilliant designs Evoking The Future Yet Suited For Today", Paul Klecka, Inc., p. 53, admitted prior art.
Declaration of Stanley Doppelt, dated Nov. 14, 1996.
Declaration of Michael Schacter, dated Dec. 31,1996.

(List continued on next page.)

*Primary Examiner*—Timothey M. Speer
(74) *Attorney, Agent, or Firm*—Akin, Gump, Strauss, Hauer & Feld, L.L.P.

(57) ABSTRACT

A composite jewelry stone is provided. The composite jewelry stone includes a first half stone having a mating edge and an opposing apex and a second half stone having a mating edge and an opposing apex. A baguette having a first mating edge and a second, opposing mating edge is provided. The baguette is mounted between the first and second half stones such that the first half stone mating edge is in alignment with the first mating edge of the baguette and the second half stone mating edge is in alignment with the second mating edge of the baguette.

18 Claims, 4 Drawing Sheets

U.S. PATENT DOCUMENTS

| | | | |
|---|---|---|---|
| D. 334,154 | 3/1993 | Benderly | D11/90 |
| D. 338,851 | 8/1993 | D'Haene | D11/90 |
| D. 350,708 | 9/1994 | Bachar | D11/90 |
| D. 372,204 | 7/1996 | Itzkowitz | D11/34 |
| D. 372,883 | 8/1996 | Adler | D11/89 |
| D. 373,971 | 9/1996 | Katz | D11/90 |
| D. 374,193 | 10/1996 | Doustorian | D11/34 |
| 948,774 | 2/1910 | Strelitz | 63/28 |
| 954,568 | 4/1910 | Gebhardt | 63/28 |
| 1,134,497 | 4/1915 | Abel et al. | 63/28 |
| 1,171,186 | 2/1916 | Frackman | 63/28 |
| 1,204,915 | 11/1916 | Whitehouse | 63/28 |
| 1,204,916 | 11/1916 | Whitehouse | 63/28 |
| 1,204,917 | 11/1916 | Whitehouse | 63/28 |
| 1,205,113 | 11/1916 | Selmeier | 63/28 |
| 1,252,966 | 1/1918 | Suderov | 63/28 |
| 1,276,132 | 8/1918 | Suderov | 63/28 X |
| 1,308,011 | 6/1919 | Gilsey | 63/26 |
| 1,322,062 | 11/1919 | Schumer et al. | 63/28 |
| 1,325,315 | 12/1919 | Cresse | 63/28 |
| 1,330,993 | 2/1920 | Whitehouse | 63/28 |
| 1,332,206 | 3/1920 | Dinhofer | 63/28 |
| 1,929,236 | 10/1933 | Bridler | 63/15 |
| 2,035,244 | 3/1936 | Pejchar | 63/26 |
| 2,207,869 | 7/1940 | Monnier | 63/28 X |
| 2,729,955 | 1/1956 | Jay | 63/15.3 |
| 2,907,187 | 10/1959 | Karp et al. | 63/28 |
| 3,394,692 * | 7/1968 | Sirakian | 63/28 X |
| 3,755,025 * | 8/1973 | Jones | 428/15 X |
| 4,392,289 * | 7/1983 | Michaud | 63/28 X |
| 4,503,687 | 3/1985 | Tessler et al. | 63/28 |
| 5,072,601 | 12/1991 | Slowinski | 63/28 |
| 5,123,265 | 6/1992 | Ramot | 63/28 |
| 5,419,159 * | 5/1995 | Muller | 63/28 |
| 5,488,839 * | 2/1996 | Udko | 63/28 |
| 5,533,364 * | 7/1996 | Freilich | 63/28 X |

OTHER PUBLICATIONS

Declaration of David Spivak, dated Jan. 6, 1997.

Photocopy of advertisement, "The Magic of Printillion® only from Orion", *Modern Jeweler*, May 1998, 3 pages, Orion Diamond Inc.

Éclat Paris International No. 23, 1992, 1 page.

Offer for sale of "Ring W/Dia Folite and Pink Formaline," Apr. 20, 1995, as evidenced by invoice from CRP to Fabrikant dated Apr. 28,1995 and letter dated Jun. 9, 1999 to Martin G. Belisario from Peter L. Berger.

* cited by examiner

COMPOSITE JEWELRY STONE

BACKGROUND OF THE INVENTION

The present invention relates to a novel arrangement of precious stones, and more particularly, to the arrangement and setting of a trio of precious stones, such as diamonds, in a manner which provides the appearance of a single larger marquise, navette or other shaped stone.

Precious stones such as diamonds have varying commercial and esthetic value depending, among other factors, on their color, clarity, cut, and size. While color, clarity and cut are important factors in the marketability of a gem or setting, the size of a gem contributes greatly to the purchaser's perception of value and desirability. Ordinarily, in order to present a large viewable surface of a precious stone such as a diamond, it is necessary to employ a large stone. This can entail a considerable expense. Unfortunately, some natural gem stones are not readily available in sufficient quantity in the desired larger sizes to meet the market demand or, if available, are prohibitively expensive in the larger sizes. As a result, certain types of larger stones, such as emeralds, are now man made. However, this solution is not practical with diamonds. Additionally, consumers generally prefer natural gem stones over artificial ones, so the creation of man made stones, where possible, does not address this problem One known solution is to employ settings that hold two smaller stones together to provide the appearance of a single larger stone. A combination of smaller stones costs less than a single larger stone having the same total weight and there is less loss of stone in the cutting process. This known technique has been attempted by the present inventor and others for producing so-called Marquise or Navette stones.

One known technique for constructing a composite marquise or navette stone has been to assemble two half-marquise stones, base-to-base, giving the appearance of a contiguous whole. The composite stone created by this method is, however, limited based on the geometry and proportions of the resulting assembled stone, as well as by the cost and availability of suitable stones for cutting larger half-marquise stones. It would therefore be desirable to create a composite marquise stone of a larger size than that produced using two half marquise stones, while still retaining the general marquise appearance in order to satisfy the demands of the market.

Some prior attempts to assemble smaller stones into a larger contiguous whole have not been entirely successful in that the assembled stones often exhibit a dark band or zone in the region of the juncture between stones and/or include joints which are apparent. Additionally, dust and dirt particles become wedged between the stones when the joints are apparent. These disadvantages detract from the value and beauty of the assembled stones.

Prior attempts to eliminate these undesirable qualities have not been entirely successful. One reason for this lack of success is that the marquise-halves or escutcheons are generally elliptical stones and the same basic cutting methods have been applied to them as has been used for the "brilliant" cutting of generally circular stones. This generally resulted in "dark zones" in the assembled stones because of less than optimal light reflection.

BRIEF SUMMARY OF THE INVENTION

Briefly stated, the present invention is a composite jewelry stone. The composite stone includes a first half stone having a mating edge and an opposing apex and a second half stone having a mating edge and an opposing apex. A baguette having a first mating edge and a second, opposing mating edge is provided. The baguette is mounted between the first and second half stones such that the first half stone mating edge is in alignment with the first mating edge of the baguette and the second half stone mating edge is in alignment with the second mating edge of the baguette.

In another aspect, the present invention provides a composite marquise jewelry stone. The composite stone includes a first half-marquise stone having a mating edge and an opposing apex and a second half-marquise stone having a mating edge and an opposing apex. A baguette having a first mating edge and a second, opposing mating edge is provided. The baguette is mounted between the first and second half-marquise stones such that the first half-marquise stone mating edge is in alignment with the first mating edge of the baguette and the second half-marquise stone mating edge is in alignment with the second mating edge of the baguette.

In another aspect, the present invention provides a composite marquise jewelry stone. The composite stone comprises a first half-marquise stone having a mating edge and an opposing apex and a second half-marquise stone having a mating edge and an opposing apex. Two baguettes, each having a first mating edge and a second, opposing, mating edge are provided. The two baguettes are mounted between the first and second half-marquise stones such that the first half-marquise stone mating edge is in alignment with the first mating edges of the two baguettes and the second half-marquise stone mating edge is in alignment with the second mating edges of the two baguettes.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figures 1, 2, 3:
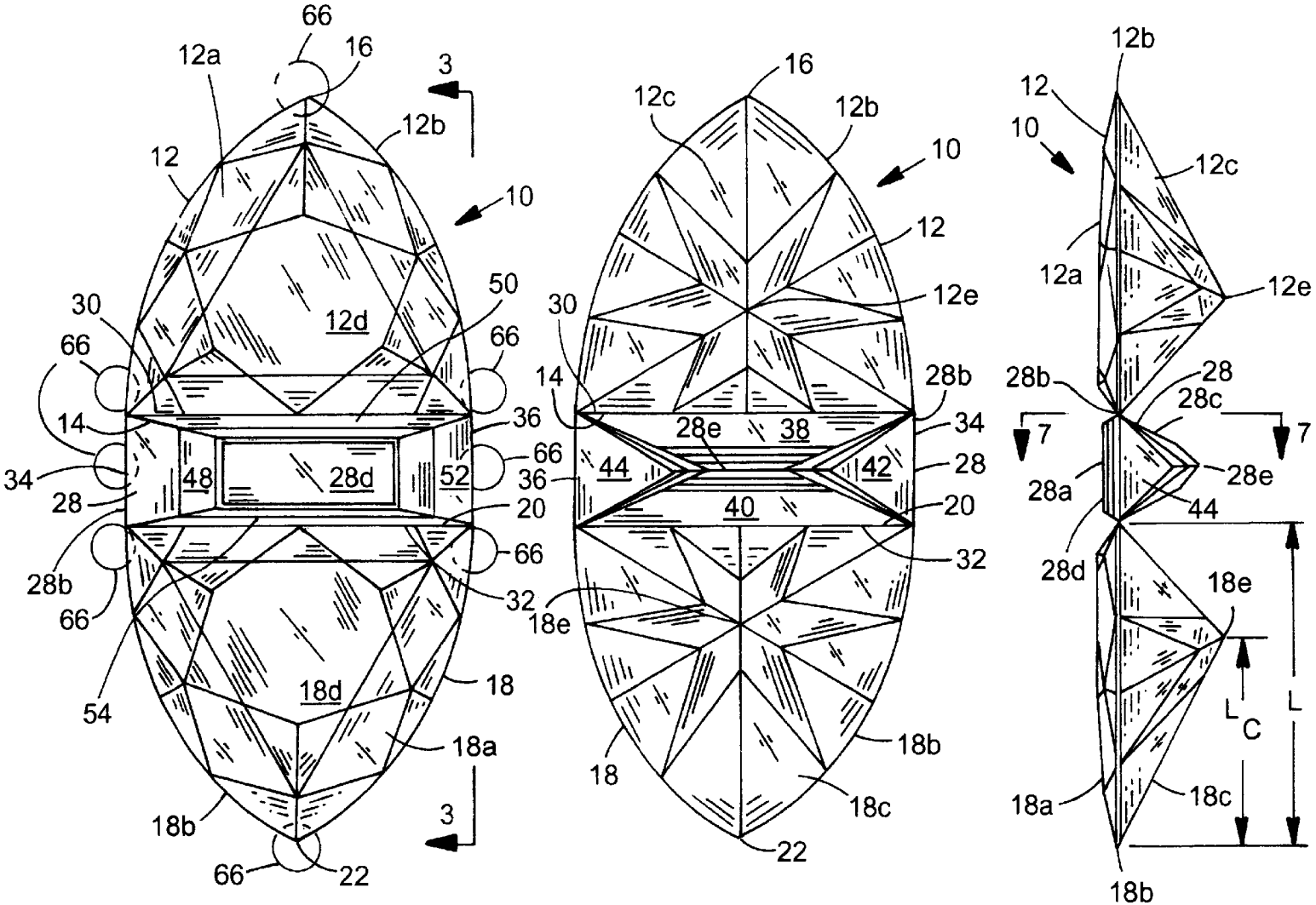
FIG. 1 is a top plan view of an assembled composite jewelry stone in accordance with a first embodiment of the present invention.
FIG. 2 is a bottom plan view thereof.
FIG. 3 is an elevational view thereof taken along lines 3—3 in FIG. 1.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the composite jewelry stones and designated parts thereof. The terminology includes the words above specifically mentioned, derivatives thereof and words of similar import.

Referring to the drawings, wherein like numerals indicate like elements throughout, there is shown in FIGS. 1–3 a first embodiment of a composite jewelry stone 10 in accordance with the present invention. The composite jewelry stone 10 preferably has an overall appearance of a marquise stone, and includes a first half stone 12, which is preferably a half-marquise stone, having a mating edge 14 and an opposing apex 16, and a second half stone 18, which is preferably a half-marquise stone, having a mating edge 20 and an opposing apex 22. The first and second half stones 12 and 18 each have a crown 12*a*, 18*a*; a girdle 12*b*, 18*b*; and a pavilion 12*c*, 18*c*. The crowns 12*a*, 18*a* each include a table facet 12*d*, 18*d*, and the pavilions 12*c*, 18*c* each include a culet apex 12*e* , 18*e*. The crowns 12*a*, 18*a* and pavilions 12*c*, 18*c* are cut in a manner which is generally known to those of ordinary skill in the art, and the particular cut is preferably a half-marquise or navette jewelry stone cut, and may be varied, if desired, as explained in more detail below. For example, the first and second half stones can be trillions, or any other desired cut.

As shown in FIG. 3, in the preferred embodiment, the first and second half-marquise stones 12, 18 each have a length L between the mating edge 14, 20 and the opposing apex 16, 22, respectively. Preferably, the culet apex 12*e*, 18*e* is located approximately 5/10 to 6/10 the length L of each half-marquise stone 12, 18 towards the mating edge 14, 20 from the opposing apex 16, 22. The culet apex 12*e* position is shown as L. in FIG. 3. It has been found that this arrangement of the culet apex 12*e*, 18*e* for both the first and second half-marquise stones 12, 18 provides for enhanced brilliance of the mounted stones.

Still with reference to FIGS. 1–3, a baguette 28 having a first mating edge 30 and a second, opposing, mating edge 32 is shown. The baguette 28 is mounted between the first and second half stones 12, 18 such that the first half stone mating edge 14 is in alignment with the first mating edge 30 of the baguette 28 and the second half stone mating edge 20 is in alignment with the second mating edge 32 of the baguette 28. Preferably, the first mating edge 30 of the baguette 28 is in abutting relation to the mating edge 14 of the first half-marquise stone 12, and the second mating edge 32 of the baguette 28 is in abutting relationship with the second half-marquise stone mating edge 20. This prevents dirt and debris from becoming trapped between the first and second mating edges 14, 30; 20, 32 of the first and second half stone 12, 18 and the baguette 28. This allows the composite jewelry stone 10 to appear more brilliant than stones with gaps between the mating edges.

As shown in FIGS. 1 and 2, preferably the first half-marquise stone mating edge 14, the second half-marquise stone mating edge 20 and the first and second mating edges 30, 32 of the baguette 28 are approximately the same length to provide the composite stone with a continuous, generally smooth edge around its periphery, without interruption.

The baguette 28 includes first and second lateral sides 34, 36 which connect the first and second mating edges 30, 32. The first and second lateral sides 34, 36 each have a length which is approximately equal, with the length of the lateral sides of the baguette 28 being approximately 2/10 to 3/10 of the length between the mating edge 14, 20 and the opposing apex 16, 22 of the one of the first and second half-marquise stones 12, 18. This relationship ensures a composite marquise jewelry stone having a generally proportional appearance and provides greater eye appeal to a prospective purchaser.

The baguette 28 has a crown 28*a* with a table facet 28*d*, a girdle 28*b*, and a pavilion 28*c*. As shown in FIG. 3, preferably the table facets 12*d*, 18*d* of the first and second half-marquise stones 12, 18 and the table facet 28*d* of the baguette 28 extend in generally the same plane, with some offset being permissible. However, keeping the table facets 12*d*, 18*d*, 28*d* of the three stones in approximately the same plane provides a more uniform appearance and enhances the illusion of a single larger stone formed by the first and second half-marquise stones 12, 18 and the baguette 28.

Referring now to FIGS. 1–3 and 7, the baguette 28 is cut to enhance the brilliance of the baguette 28 and reduce dark bands or zones in the composite jewelry stone 10 by creating an enhanced reflection and play of light through the baguette 28 based on the faceting on the crown 28*a* and the pavilion 28*c*. The first lateral edge 34 is located along the girdle 28*b* and the second, opposing lateral edge 36 is located opposite to the first lateral edge 34 with the first and second lateral edges 34, 36 and the first and second mating edges 30, 32 generally forming a parallelogram, which is preferably rectangular.

Figure 7:
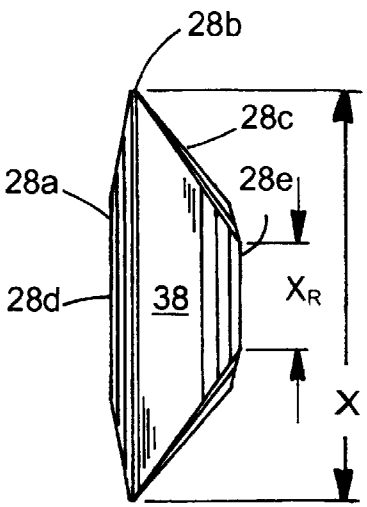
FIG. 7 is a rear elevational view of a baguette used in the composite jewelry stones of the first and second embodiments taken along lines 7—7 in FIG. 3 and FIG. 6.

As shown in FIGS. 2 and 7, the baguette 28 includes a first primary end pavilion facet 38 having first, second, third and fourth sides with the second and third sides being of approximately equal length. The first, second, third and fourth sides form a generally trapezoidal shape. The first side is approximately coequal in length with and adjacent to the first mating edge 30. The second and third sides extend inwardly at an acute angle to intersect at the fourth side.

The baguette 28 also includes a second primary end pavilion facet 40 having first, second, third and fourth sides. The second and third sides are approximately equal in length, with the first, second, third and fourth sides forming a generally trapezoidal shape. The first side is approximately coequal in length with and adjacent to the second mating edge 32, and the second and third sides extend inwardly at an acute angle to intersect the fourth side. The fourth sides of the first and second primary end pavilion facets 38, 40 are coextensive and form a pavilion culet ridge 28*e*.

The baguette 28 also includes a first primary lateral pavilion facet 42 having first, second and third sides, with the second and third sides being approximately equal in length. The first, second and third sides form a generally triangular shape. The first side is approximately coequal in length with and adjacent to the first lateral edge 34, and the second and third sides are generally of equal length and intersect at the pavilion culet ridge 28*e*.

The baguette 28 includes a second a primary lateral pavilion facet 44 having first, second and third sides which form a generally triangular shape. The first side is coequal in length with and adjacent to the second lateral edge 36 of the baguette 28. The second and third sides intersect at the pavilion culet ridge 28*e*.

As shown most clearly in FIGS. 2 and 7, preferably the first and second primary end pavilion facets 38 and 40 each include four facets, with the facets having edges which extend parallel to the pavilion culet ridge 28*e*. The four facets are preferably located adjacent to the pavilion culet ridge 28*e* and enhance the brilliance and light reflecting qualities of the baguette 28. Additional facets are also preferably provided on the first and second primary lateral pavilion facets 42, 44 as shown most clearly in FIGS. 2 and 3. These all combine to eliminate dark bands or zones in the baguette and at the junctures between the first and second half-marquise stones 12, 18 and the baguette 28 by reflecting light toward these areas.

Referring to FIGS. 1, 3 and 7, the crown 28*a* of the baguette 28 has a generally rectangular table 28*d* with four edges. Four primary bezel facets 48, 50, 52 and 54 are located between the girdle 28*b* and the table 28*d*. Each primary bezel facet 48, 50, 52 and 54 extends from one of the first and second mating edges 30, 32 and the first and second lateral edges 34, 36 at the girdle 28*b* to the edges of the generally rectangular table facet 28*d*. Preferably, each primary bezel facet 48, 50, 52, 54 comprises three generally trapezoidal facets, as shown in detail in FIGS. 1, 3 and 7.

As shown in FIG. 7, the mating edges 30, 32 of the baguette 28 have a length X and the pavilion culet ridge 28*e* has a length $X_R$ which is approximately 2/10 to 5/10 of the length of the mating edges 30, 32. This arrangement provides enhanced light reflection through the baguette 28 to greatly reduce or eliminate any dark bands.

Referring again to FIG. 1, prongs or hold downs 66 from a setting (not shown) are illustrated in phantom lines in order to show the mounting of the composite marquise jewelry stone 10. Prongs or hold downs of this type are generally known to those skilled in the art, and accordingly, a description of the actual mounting of the composite marquise jewelry stone 10 is not believed to be necessary or limiting.

Figure 6:
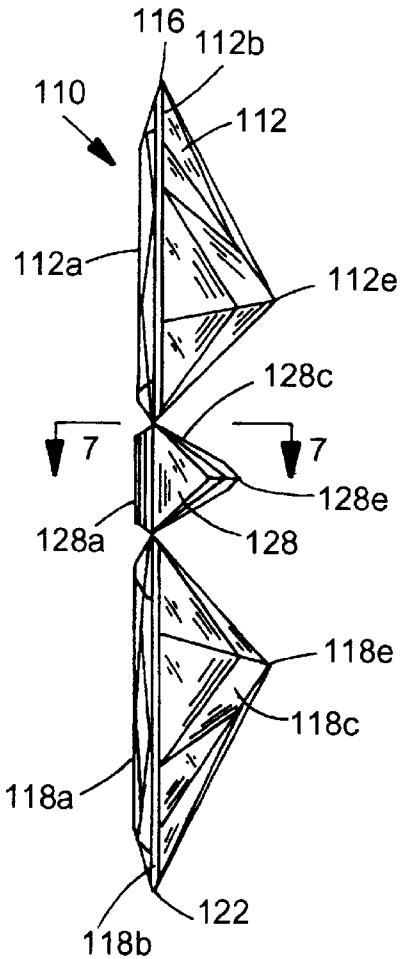
FIG. 6 is a right side elevational view thereof, partially exploded, taken along line 6—6 in FIG. 4.
Figure 5:
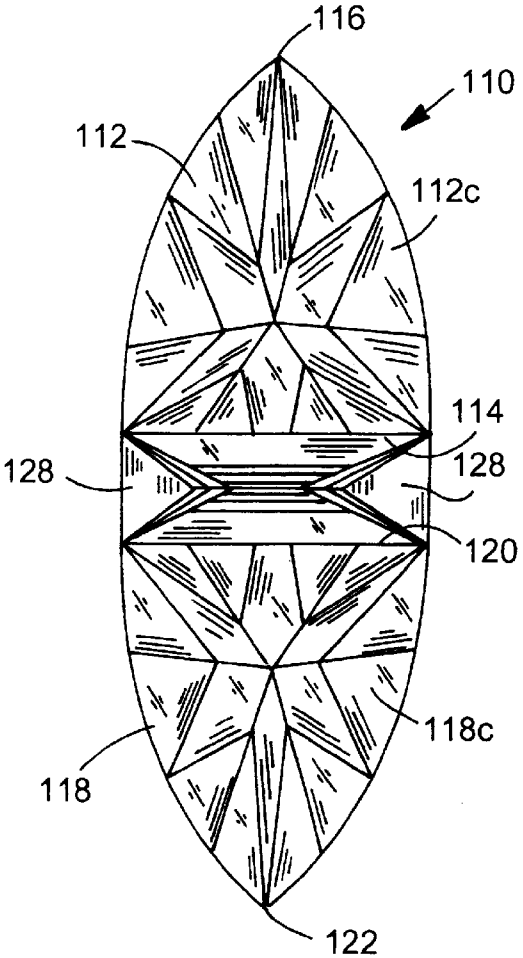
FIG. 5 is a bottom plan view thereof.
Figure 4:
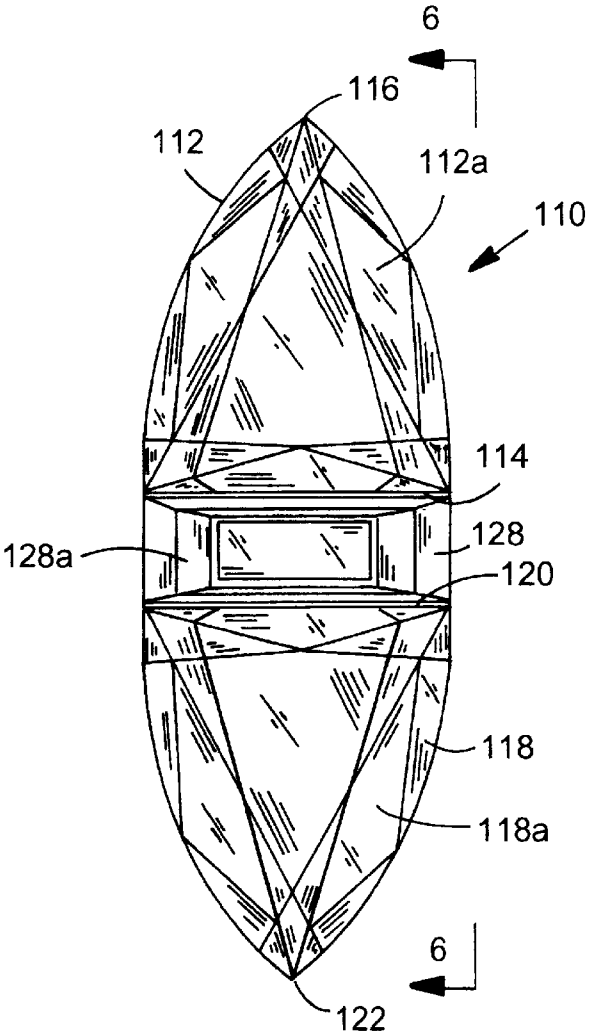
FIG. 4 is a top plan view of a second embodiment of a composite jewelry stone in accordance with the present invention.

Referring now to FIGS. 4–6, a second embodiment of a composite marquise jewelry stone 110 is shown. The second embodiment of the composite marquise jewelry stone 110 is similar to the first embodiment 10, and like elements have been identified with the same reference numeral having the prefix "1". For example, the first half-marquise stone 12 of the composite marquise jewelry stone 10 in accordance with the first preferred embodiment of the invention is similar to the first half-marquise stone 110 of the second embodiment. Reference numerals have been provided to identify the similar elements; however, a detailed description of all of the similar elements is not believed to be necessary. The differences between the first embodiment 10 and the second embodiment 110 are described in detail below.

In the second embodiment of the composite marquise jewelry stone 110, the first half-marquise stone and the second half-marquise stone 112, 118 are cut with different style facets on the crown 112*a*, 118*a*. Additionally, the overall proportion of the first and second half-marquise stones is slightly changed to have a longer distance between the apexes 116, 122 and the opposing mating edges 114, 120. First and second half-marquise stones 112, 118 in this style are known to those skilled in the art. The first and second-half marquise stones 112, 118 are combined with a baguette 128 to form the composite marquise jewelry stone 110. The use of the baguette 128 helps to reduce the dark bands or zones along the mating areas of the three stones 112; 118, 128. The stones 112, 118, 128 are mounted in the same manner as in the first embodiment 10.

Figure 9:
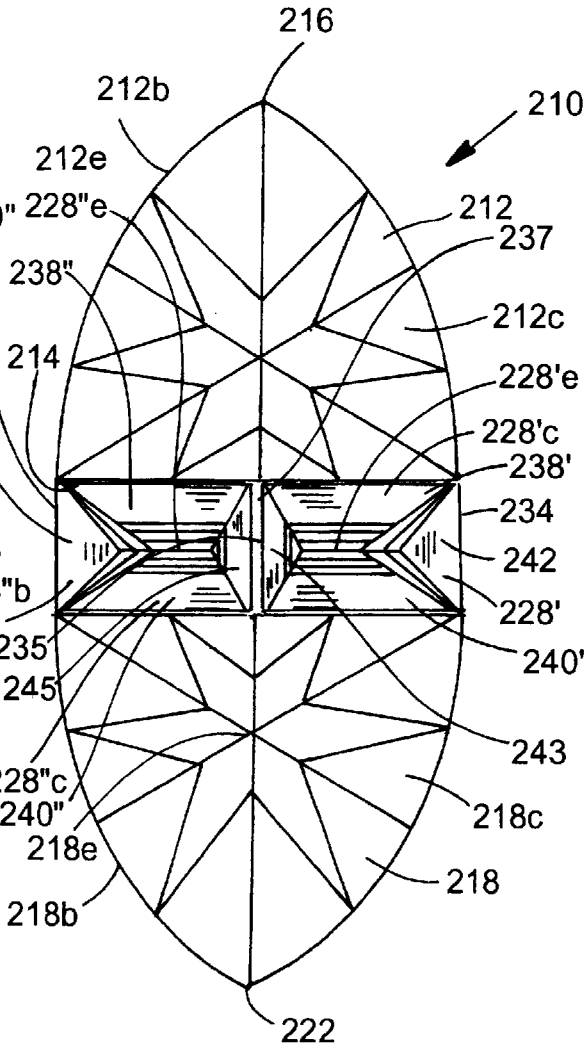
FIG. 9 is a bottom plan view thereof.
Figure 8:
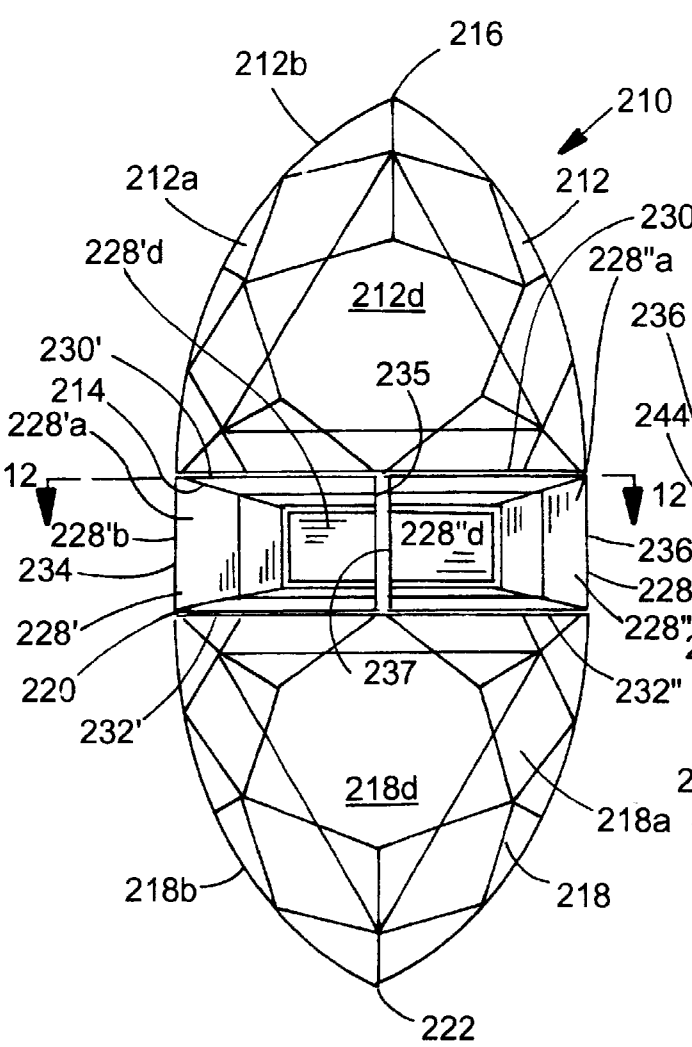
FIG. 8 is a top plan view of a third embodiment of a composite jewelry stone in accordance with the present invention.
Figure 12:
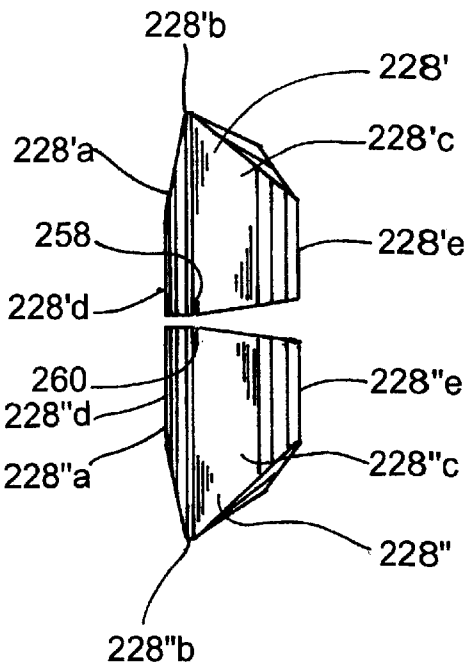
FIG. 12 is a rear elevational view, rotated 90° clockwise, of two baguettes used in the composite jewelry stones of the third and fourth embodiments of the present invention taken along lines 12—12 in FIGS. 8 and 10.

Referring now to FIGS. 8, 9 and 12, a third embodiment of a composite marquise jewelry stone 210 is shown. The third preferred embodiment of the composite marquise jewelry stone 210 is similar to the first preferred embodiment 10 and like elements have been identified with similar reference numerals having the prefix "2". For example, the first half-marquise stone 12 of the first preferred embodiment 10 of the invention is similar to the first half-marquise stone 212 in accordance with the third preferred embodiment of the invention 210. The differences between the first and third embodiments are described in detail below.

In the third embodiment of the composite marquise jewelry stone 210, first and second half-marquise stones 212 and 218 having the same crown and pavilion facets as disclosed in the first preferred embodiment 10 are provided. Two baguettes 228' and 228" are mounted between the first half-marquise stone 212 and the second half-marquise stone 218. Each of the two baguettes 228' and 228" has a first mating edge 230', 230" and a second, opposing, mating edge 232', 232". The first half-marquise stone mating edge 214 is in alignment with the first mating edges 230', 230" of the two baguettes 228', 228". Similarly, the second half-marquise stone mating edge 220 is in alignment with the second mating edges 232', 2321" of the two baguettes 228', 228". Each of the two baguettes 228', 228" includes an outer lateral edge 234, 236 and mating internal lateral edges 235, 237. The mating internal lateral edges 235, 237 of the two baguettes 228', 228" are in abutting alignment with each other. However, in order to clearly illustrate the stones, a space is shown between the two baguettes 228', 228" in FIGS. 8, 9 and 12.

The use of two baguettes 228', 228" allows the composite marquise jewelry stone 210 to be assembled using smaller baguette stones while still providing the overall composite marquise jewelry stone appearance at a reduced cost. The side view of the composite marquise jewelry stone 210 is identical to that shown in FIG. 3 in connection with the first preferred embodiment 10 since the mating internal lateral edges 235, 237 of the two baguettes 228', 228" are not visible from the side when the composite marquise jewelry stone is assembled.

As shown in detail in FIG. 12, preferably a shelf cut 258, 260 is located along the mating internal lateral edges 235, 237 of the two baguettes 228', 228". The shelf cuts are used for invisible setting of the two baguettes 228', 228" along the mating internal lateral edges 235, 237. Shelf cuts of this type are generally known to those skilled in the art for invisible gem stone setting, for example as shown in U.S. Pat. No. 5,123,265 which is incorporated by reference as if fully set forth.

Preferably, the two baguettes 228', 228" each include a crown 228'*a*, 228"*a* having facets similar to those described in conjunction with the baguette 28 in accordance with the first preferred embodiment 10 such that when the two baguettes 228' and 228" are assembled in a setting (not shown), the assembled crowns 228'*a*, 228"*a* provide the same general appearance as the crown 28*a* of baguette 28, with the exception of the seam along the mating internal lateral edges 235, 237.

Similarly, each of the two baguettes 228', 228" includes a pavilion 228'*c*, 228"*c* which is cut such that when the two baguettes 228', 228" are assembled in the setting, the pavilions 228'*c*, 228"*c* provide a similar appearance to that provided by the baguette 28 in accordance with the first preferred embodiment 10. Specifically, primary end facets 238', 238" and 240', 240" extend from the first and second mating edges 230', 230", 232', 232" to the respective pavilion culet ridges 228'*e*, 228"*e*. A first outer primary lateral facet 242 is located on the first baguette 228', and a first outer primary facet 244 is located on the second baguette 228". Internal primary facets 243, 245, which are generally triangular in shape extend from the mating internal lateral edges 235, 237 of each baguette 228', 228" to the respective pavilion culet ridges 228'*e*, 228"*e* for each of the two baguettes 228', 228". Preferably, the additional internal primary facets which extend from the mating internal lateral edges 235, 237 comprises four facets which are generally aligned with the four facets on the first and second primary end pavilion facets 238', 238", 240', 240". This provides for increased light reflection through the baguettes 228', 228" in order to reduce or eliminate dark zones or bands caused by poor light transmittance and reflection through the baguettes 228', 228".

As shown in FIG. 12, the table facets 228'*d*, 228"*d* of the two baguettes 228', 228" are generally in the same plane with the table facets 212*d*, 218*d* of the first and second half-marquise stones 212, 218.

The stones 212, 218, 228' and 228" are set in a similar manner to the first embodiment 10 with the addition of an invisible gem stone setting which engages the shelf cuts 258, 260 to anchor the internal lateral edges 235, 237 of the two baguettes 228', 228".

Figure 11:
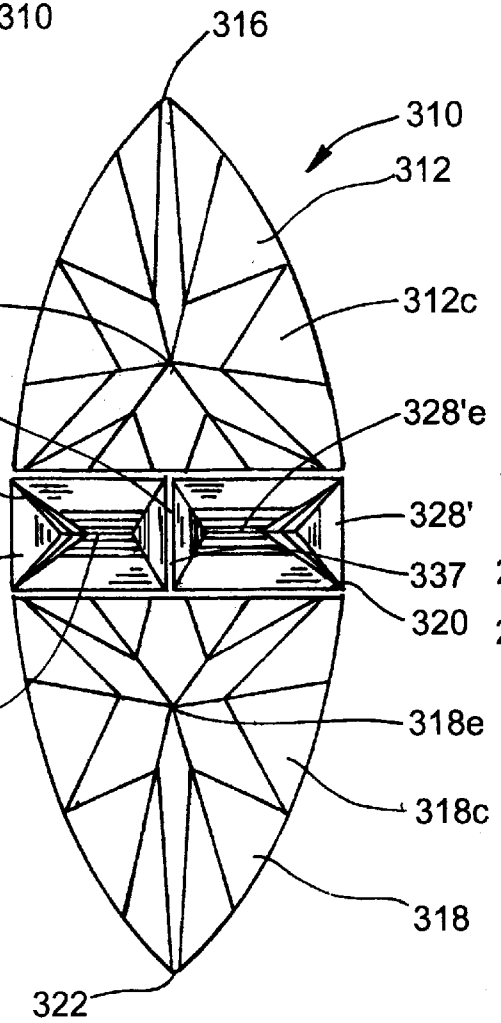
FIG. 11 is a bottom plan view thereof.
Figure 10:
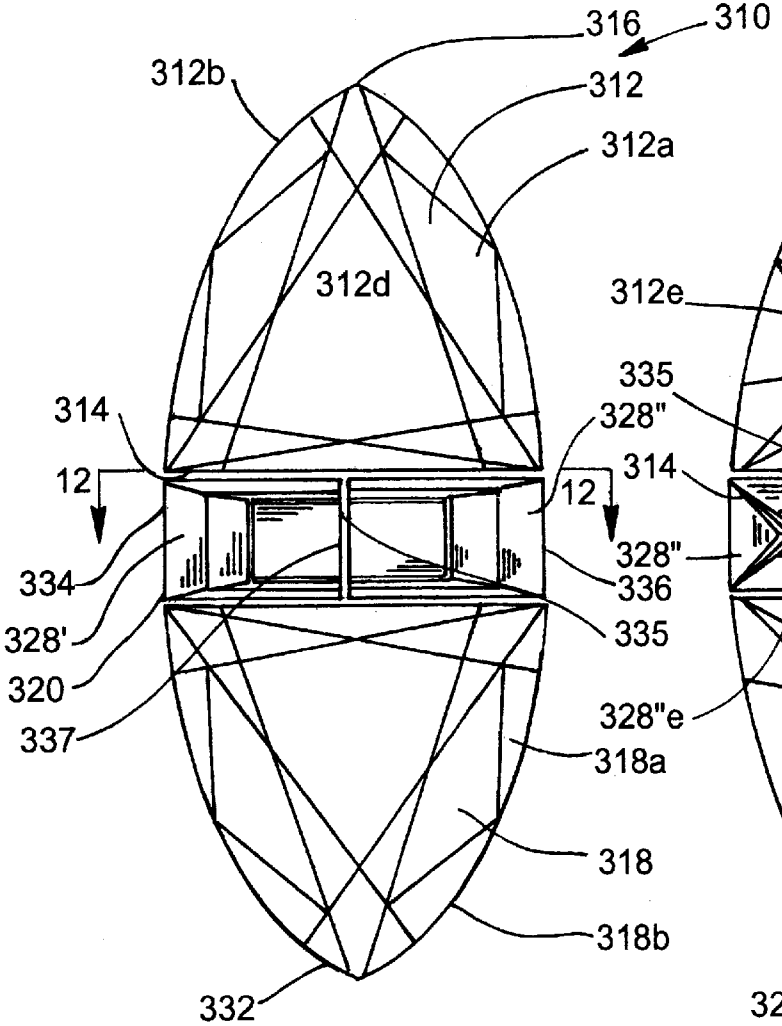
FIG. 10 is a top plan view of a fourth embodiment of a composite jewelry stone in accordance with the present invention.

Referring now to FIGS. 10 and 11, a fourth preferred embodiment of a composite marquise jewelry stone 310 is shown. The composite marquise jewelry stone 310 in accordance with the fourth preferred embodiment of the invention is similar to the third embodiment of the invention 210 and like elements have been identified with similar reference numerals having the hundreds digit "3". For example, the first half-marquise stone 312 in accordance with the fourth preferred embodiment is similar to the first half-marquise stone 210 in accordance with the third preferred embodiment. The differences between the third and fourth preferred embodiments of the invention are described in detail below.

As shown in FIGS. 10 and 11, the composite marquise jewelry stone 310 in accordance with the fourth preferred embodiment of the invention includes two baguettes 338', 338" which are the same as those used in connection with the third preferred embodiment of the invention 210. The first and second half-marquise stones 312, 318 are the same as those used in connection with the second preferred embodiment of the invention 110 and have the same crown and pavilion facets as the first and second half-marquise stones 112, 118.

The side view of the fourth preferred embodiment of the invention 310 is the same as the second preferred embodiment 110, as shown in FIG. 6, since the seam between the two baguettes 328', 328" is not apparent from the sides.

Again, the use of two baguettes 328', 328" provides the perception of a larger composite stone at a reduced cost and the faceting of the two baguettes 328', 328" produces or eliminates the dark bands or zones to enhance the overall appearance of the composite marquise jewelry stone 310.

Those skilled in the art will recognize that a similar mounting arrangement can be used for the fourth embodiment of the composite marquise jewelry stone 310 to the third embodiment of the composite marquise jewelry stone 210, with an invisible setting being used to anchor in the shelf cuts in the two baguettes 328', 328".

It will be recognized by those of ordinary skill in the art that the present invention provides a composite marquise jewelry stone 10, 110, 210, 310 having a greater size than the known composite marquise jewelry stones which were previously assembled from only first and second half-marquise stones by utilizing a baguette while maintaining the same general overall proportions of the stone. Additionally, based on the cutting of the baguette and the inclusion of a pavilion culet ridge, enhanced light reflecting and transmitting qualities are provided in the baguette to reduce or eliminate dark bands or zones and enhance the overall eye appeal of the composite marquise jewelry stone 10, 110, 210, 310.

The jewelry stone 10, 110, 210, 310 in accordance with the present invention can be used in various types of jewelry, such as rings, pins, necklaces, earrings and bracelets, or any other type of setting. Additionally, the invention is not limited to the types of first and second half stones which are used in conjunction with the baguette 28, 128, or multiple baguettes 228', 228", 328', 328". For example, the composite jewelry stone could be assembled with first and second trillions with one or more baguettes located between the trillions.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A composite jewelry stone, comprising:

a first half stone having a mating edge and an opposing apex;

a second half stone having a mating edge and an opposing apex; and a baguette having a first mating edge and a second, opposing, mating edge, the baguette being mounted between the first and second half stones such that the first half mating edge is in alignment with the first mating edge of the baguette and the second half mating edge is in alignment with the second mating edge of the baguette.

2. A composite marquise jewelry stone, comprising:

a first half-marquise stone having a mating edge and an opposing apex;

a second half-marquise stone having a mating edge and an opposing apex; and a baguette having a first mating edge and a second, opposing, mating edge, the baguette being mounted between the first and second half-marquise stones such that the first half-marquise mating edge is in alignment with the first mating edge of the baguette and the second half-marquise mating edge is in alignment with the second mating edge of the baguette.

3. The composite marquise jewelry stone according to claim 2 wherein the first mating edge of the baguette is in abutting relationship to the mating edge of the first half-marquise stone, and the second mating edge of the baguette is in abutting relationship with the second half-marquise stone mating edge.

4. The composite marquise jewelry stone according to claim 2, wherein the first half-marquise mating edge, the second half-marquise mating edge, and the first and second mating edges of the baguette are approximately the same length.

5. The composite marquise jewelry stone according to claim 2 wherein the first and second half-marquise stones each have a length between the mating edge and the opposing apex, and include a culet apex, the culet apex being located approximately 5/10 to 6/10 of the length of each stone towards the mating edge from the opposing apex.

6. The composite marquise jewelry stone according to claim 5 wherein the baguette includes first and second lateral sides which connect the first and second mating edges, the first and second lateral sides each having a length which is approximately equal, the length of the lateral sides of the baguette being approximately 2/10 to 3/10 of the length between the opposing edge and the apex of one of the first and second half-marquise stones.

7. The composite jewelry stone of claim 2 wherein the first and second half-marquise stones and the baguette each have a crown with a table facet, and the table facets of the first and second half-marquise stones and the baguette extend generally in the same plane.

8. The composite marquise jewelry stone according to claim 2, wherein the baguette further comprises:

a girdle;

a first lateral edge along the girdle;

a second, opposing, lateral edge, the first and second lateral edges and the first and second mating edges generally forming a parallelogram;

a first primary end pavilion facet, having first, second, third and fourth sides, the second and third sides being of approximately equal length, the first, second, third and fourth sides forming a generally trapezoidal shape, the first side being approximately coequal in length with and adjacent to the first mating edge, the second and third sides extending inwardly at an acute angle to intersect the fourth side;

a second primary end pavilion facet, having first, second, third and fourth sides, the second and third sides being of approximately equal length, the first, second, third and fourth sides forming a generally trapezoidal shape, the first side being approximately coequal in length with and adjacent to the second mating edge, the second and third sides extending inwardly at an acute angle to intersect the fourth side which is coextensive with the fourth side of the first lateral pavilion facet to form a pavilion culet ridge;

a first primary lateral pavilion facet having first, second, and third sides, the second and third sides being of approximately equal length, the first, second and third sides forming a generally triangular shape, the first side being approximately coequal in length with and adjacent to the first lateral edge, the second and third sides intersecting at the pavilion culet ridge; and a second primary lateral pavilion facet having first, second, and third sides forming a generally triangular shape, the first side coequal in length with and adjacent to the second lateral edge, the second and third sides intersecting at the pavilion culet ridge.

9. The composite marquise jewelry stone according to claim 8 wherein the first and second primary end pavilion facets includes four facets, the four facets having edges which extend parallel to the pavilion culet ridge.

10. The composite marquise jewelry stone according to claim 8, wherein the baguette includes a crown having a generally rectangular table with four edges, four primary bezel facets being located between the girdle and the table, each primary bezel facet extending from one of the first and second mating edges and the first and second lateral edges to the edges of the generally rectangular table facet.

11. The composite marquise jewelry stone according to claim 10 wherein each of the four primary bezel facets comprises three generally trapezoidal facets.

12. The composite marquise jewelry stone according to claim 8 wherein the mating edges of the baguette have a length and the culet ridge has a length which is approximately 2/10 to 5/10 of the length of the mating edges.

13. The composite marquise jewelry stone according to claim 2, wherein there are two baguettes, each having a first mating edge and a second, opposing, mating edge, each of the two baguettes being mounted between the first half-marquise stone and the second half-marquise stone such that the first half-marquise mating edge is in alignment with the first mating edges of the two baguettes and the second half-marquise stone mating edge is in alignment with the second mating edges of the two baguettes, each of the two baguettes including an outer lateral edge and a mating inner lateral edge, the mating inner lateral edges of the two baguettes being in alignment with each other.

14. The composite marquise jewelry stone of claim 13 wherein a shelf cut is located along the mating inner lateral edges of each of the two baguettes which is adapted to receive a setting.

15. The composite marquise jewelry stone of claim 13 wherein the two baguettes are substantially identical in shape.

16. A composite marquise jewelry stone, comprising:

a first half-marquise stone having a mating edge and an opposing apex;

a second half-marquise stone having a mating edge and an opposing apex; and two baguettes, each having a first mating edge and a second, opposing, mating edge, the two baguettes being mounted between the first and second half-marquise stones such that the first half-marquise mating edge is in alignment with the first mating edges of the two baguettes and the second half-marquise mating edge is in alignment with the second mating edges of the two baguettes.

17. The composite marquise jewelry stone according to claim 16, wherein each of the two baguettes includes an outer lateral edge and a mating inner lateral edge, the mating inner lateral edges of the two baguettes being in alignment with each other.

18. The composite marquise jewelry stone of claim 17 wherein a shelf cut is located along the mating inner lateral edges of each of the two baguettes which is adapted to receive a setting.

* * * * *